US005894707A

United States Patent [19]

May

[11] Patent Number: 5,894,707

[45] Date of Patent: Apr. 20, 1999

[54] METHOD FOR MAKING FLEXIBLE PACKAGE WITH HANGHOLE AND TEAR STRING

[75] Inventor: Timothy J. May, Greenville, Wis.

[73] Assignee: Reynolds Consumer Products, Inc., Appleton, Wis.

[21] Appl. No.: 08/839,116

[22] Filed: Apr. 23, 1997

Related U.S. Application Data

[62] Division of application No. 08/644,092, May 10, 1996, Pat. No. 5,749,657.

[51] Int. Cl.[6] ..... B65B 61/20

[52] U.S. Cl. ..... 53/133.7; 53/412; 53/455; 53/413; 53/562; 493/226; 493/960

[58] Field of Search ..... 53/412, 455, 133.4, 53/133.5, 133.7, 139.2, 413, 134.1, 562; 156/66; 493/63, 68, 210, 213, 214, 227, 225, 231, 923, 927, 928, 930, 226

[56] References Cited

U.S. PATENT DOCUMENTS

| | | | |
|---|---|---|---|
| 3,008,837 | 11/1961 | Kaplan . | |
| 3,047,206 | 7/1962 | Monahan et al. . | |
| 3,319,538 | 5/1967 | Bodolay et al. | 53/455 |
| 3,460,741 | 8/1969 | Kugler . | |
| 3,502,258 | 3/1970 | Kugler et al. . | |
| 3,528,600 | 9/1970 | White . | |
| 3,663,239 | 5/1972 | Rowe et al. . | |
| 3,720,036 | 3/1973 | Armstrong | 53/14 |
| 3,730,421 | 5/1973 | Stanley . | |
| 3,873,735 | 3/1975 | Chalin et al. . | |
| 4,174,597 | 11/1979 | Mowli et al. | 53/455 |
| 4,545,521 | 10/1985 | Hiersteiner . | |
| 4,842,421 | 6/1989 | Bullard et al. . | |
| 4,880,316 | 11/1989 | Belmont et al. . | |
| 4,892,512 | 1/1990 | Branson | 493/194 |
| 4,898,280 | 2/1990 | Runge . | |
| 4,953,708 | 9/1990 | Beer et al. . | |
| 5,009,828 | 4/1991 | McCree | 264/177.1 |
| 5,022,530 | 6/1991 | Zieke . | |
| 5,036,643 | 8/1991 | Bodolay . | |
| 5,100,246 | 3/1992 | La Pierre et al. . | |
| 5,116,140 | 5/1992 | Hirashima . | |
| 5,186,543 | 2/1993 | Cochran . | |
| 5,405,629 | 4/1995 | Marnocha et al. . | |
| 5,425,216 | 6/1995 | Ausnit | 53/410 |
| 5,519,982 | 5/1996 | Herber et al. | 53/412 |
| 5,525,363 | 6/1996 | Herber et al. . | |
| 5,673,541 | 10/1997 | Arzuman et al. | 53/459 |

FOREIGN PATENT DOCUMENTS

| | | |
|---|---|---|
| 5221454 | 8/1993 | Japan . |

*Primary Examiner*—Stephen F. Gerrity
*Assistant Examiner*—Matthew Luby
*Attorney, Agent, or Firm*—Alan M. Biddison

[57] ABSTRACT

A flexible package includes first and second opposed panel sections, a header section having a hanghole, and a tear string. The header section is positioned adjacent the first and second panel sections and encloses a portion of the package. The tear string is enclosed and arranged in the header section to provide hanging support at the hanghole and to tear open the enclosed portion in response to a pulling force at an end of the tear string. A method and apparatus for making the flexible package are also featured.

14 Claims, 7 Drawing Sheets

METHOD FOR MAKING FLEXIBLE PACKAGE WITH HANGHOLE AND TEAR STRING

This application is a division of Ser. No. 08/644,092 filed May 10, 1996. (now U.S. Pat. No. 5,749,657)

FIELD OF THE INVENTION

The present invention relates generally to packaging arrangements. More particularly, this invention relates to sealed flexible packaging arrangements having a hole for hanging the package.

BACKGROUND OF THE INVENTION

Packaging and displaying a product can be an important way for the producer/manufacturer to feature the product and to distinguish it from the competition. For example, a packaging arrangement which permits extensive display and graphics capabilities sometimes plays a significant role from a marketing perspective. It is therefore desirable to provide a package which allows the package to be easily displayed and to have a large enough surface area to allow for graphics.

One way of providing such display capabilities is to include a hanghole in the top of the package to permit the arrangement to be hung from a hook for vertical display.

It is also advantageous to provide features in the packaging which consumers will appreciate for convenience and safety. For example, it is often desirable for many consumers to be able to easily and effectively reseal a package after it has been opened. One way of accomplishing that is through reclosable zipper seals. Reclosable seals alone, however, do not provide a way to indicate that the package may have been tampered with before the purchase. For this reason, packages with reclosable zippers have been permanently sealed above or below the reclosable zipper in such a manner that the opening of the package becomes apparent.

In the manufacture and use of sealed packages, there are a number of drawbacks. One drawback is that while the seal inhibits tampering, it also makes it difficult for the consumer to open the package or break the seal. Another drawback is the competition between the large surface area to display graphics and the need for adequate material for the hanghole. Further, there should be sufficient area above the hanghole to prevent the weight of the package from tearing through the hanghole. Yet another drawback in the design of such packages is the need to contain costs by minimizing the amount of film used to manufacture the package.

Accordingly, there is a need for a packaging arrangement which overcomes the aforementioned drawbacks and yet realizes production-related cost objectives.

SUMMARY OF THE INVENTION

The present invention is directed to a flexible packaging arrangement, including the package itself, and the manufacture of the package.

One embodiment of the present invention includes a flexible package having first and second opposed panel sections, a header section having a hanghole, and a tear string. The header section is positioned adjacent the first and second panel sections and encloses a portion of the package. The tear string is enclosed and arranged in the header section to provide hanging support at the hanghole and to tear open the enclosed portion in response to a pulling force at the tear string.

In one implementation of the above embodiment, the hanghole includes the tear string as an integral part of the hanghole. In another implementation, the tear string is positioned adjacent the hanghole.

In certain applications, a flexible package in accordance with the invention includes a reclosable system attached to the header section. In one implementation, the reclosable system includes a reclosable zipper. In another implementation, the reclosable system includes a pressure sensitive adhesive.

In yet another application of the present invention, a flexible package is a polymeric bag, having first and second panel sections which are substantially rectangular and are heat sealed together along at least three edges, for example, the sides and bottom.

The flexible package may include at least one tear notch in the header section adjacent the tear string. In one application, the flexible package includes a pair of tear notches in the header section adjacent to opposite ends of the tear string.

The header section includes opposing inside walls, and the tear string is completely sealed to the opposing inside walls of the header section. The tear string may include a high density polyethylene cord, where the cord is surrounded by a low temperature sealant.

In another implementation, the present invention comprises a method for making a flexible package comprising unrolling a web of film, punching a hole in a header area of the film, positioning a tear string across the film in the header area, and arranging the film into a plurality of individual packages.

In one implementation, arranging the film includes folding the film along the diameter of the hole, cutting the film into individual packages having three pairs of exposed edges, sealing two pairs of edges to leave a third pair of edges unsealed, filling the packages with a product, and sealing the third pair of edges. In this implementation, when positioning the tear string, the tear string is positioned across the hole, and the tear string is pushed in the hole to create a loop. In this implementation, the method further includes sealing the tear string on a first area of the film on a first side of the hole, before the tear string is pushed in the hole. The method may further include sealing the tear string on a second area of the film on a second side of the hole, after the tear string is pushed in the hole.

In another implementation, punching the hole includes punching a pair of holes in the film. When arranging the film, the film may be folded between the pair of holes to ensure that the holes are aligned together, the film is cut into individual packages having three pairs of exposed edges, two pairs of edges may be sealed to leave a third pair of edges unsealed, the packages are filled with a product, and the third pair of edges is sealed. Positioning the tear string includes positioning the tear string between the pair of holes.

In another implementation, the invention comprises an apparatus for making a flexible package including a roll of thermoplastic film; a conveyor used to unroll the film and move it downstream; a punch which punches a hole in the film; a roll of tear string which is positioned onto the film; a pair of guides for folding the film; and a separator which cuts the film to form exposed edges and sealing the edges to form an individual package.

The apparatus may include a roll of reclosable zippers for being positioned onto the film.

In one implementation, the apparatus may include a punch which pushes the tear string across the hole.

In another implementation, the apparatus may include a second punch which punches a second hole in the film.

The above summary of the present invention is not intended to describe each illustrated embodiment or implementation of the present invention. This is the purpose of the figures and the associated discussion which follows.

BRIEF DESCRIPTION OF THE DRAWINGS

Other aspects and advantages of the present invention will become apparent upon reading the following detailed description and upon reference to the drawings in which.

DETAILED DESCRIPTION OF THE ILLUSTRATED EMBODIMENTS

Figure 6:
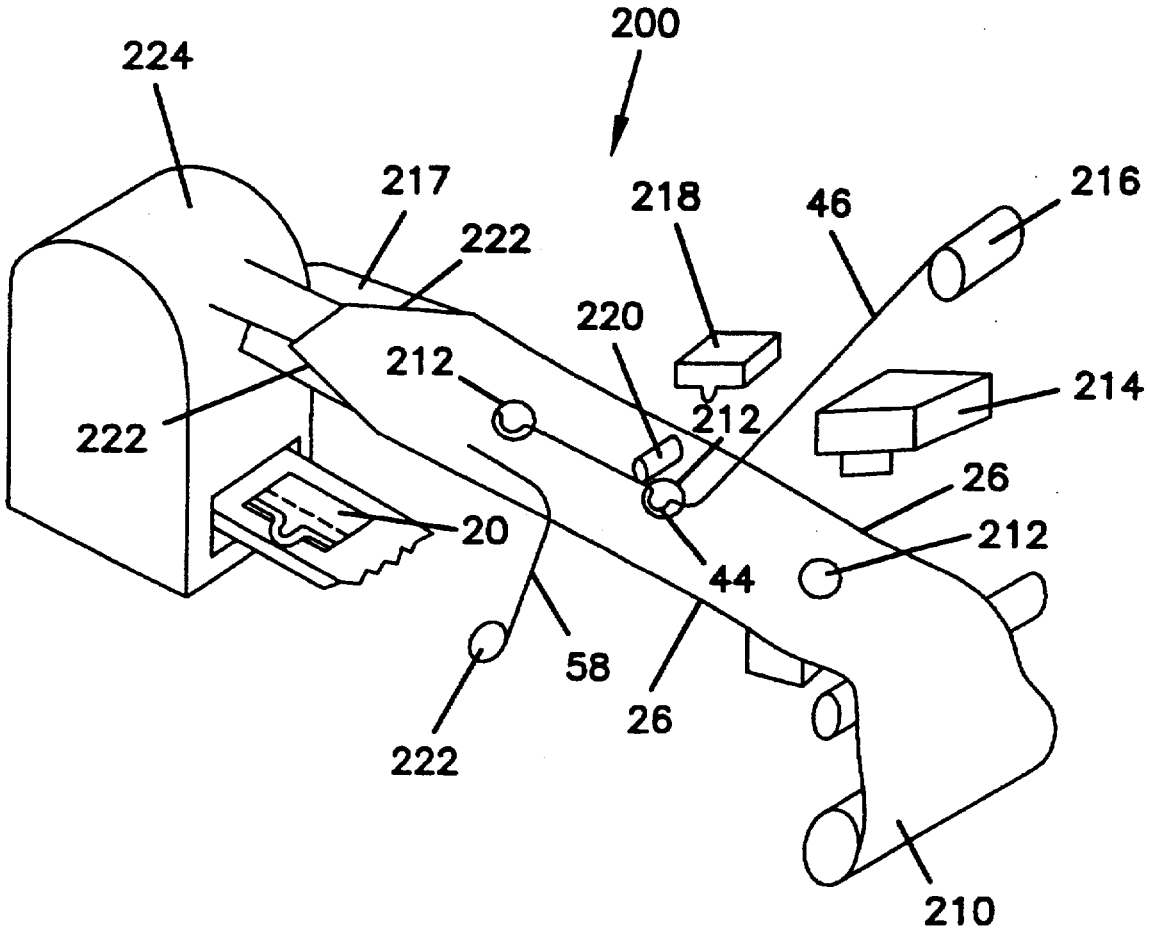
FIG. 6 is a schematic view of one embodiment of a machine for making the flexible package of FIG. 1.
Figure 7:
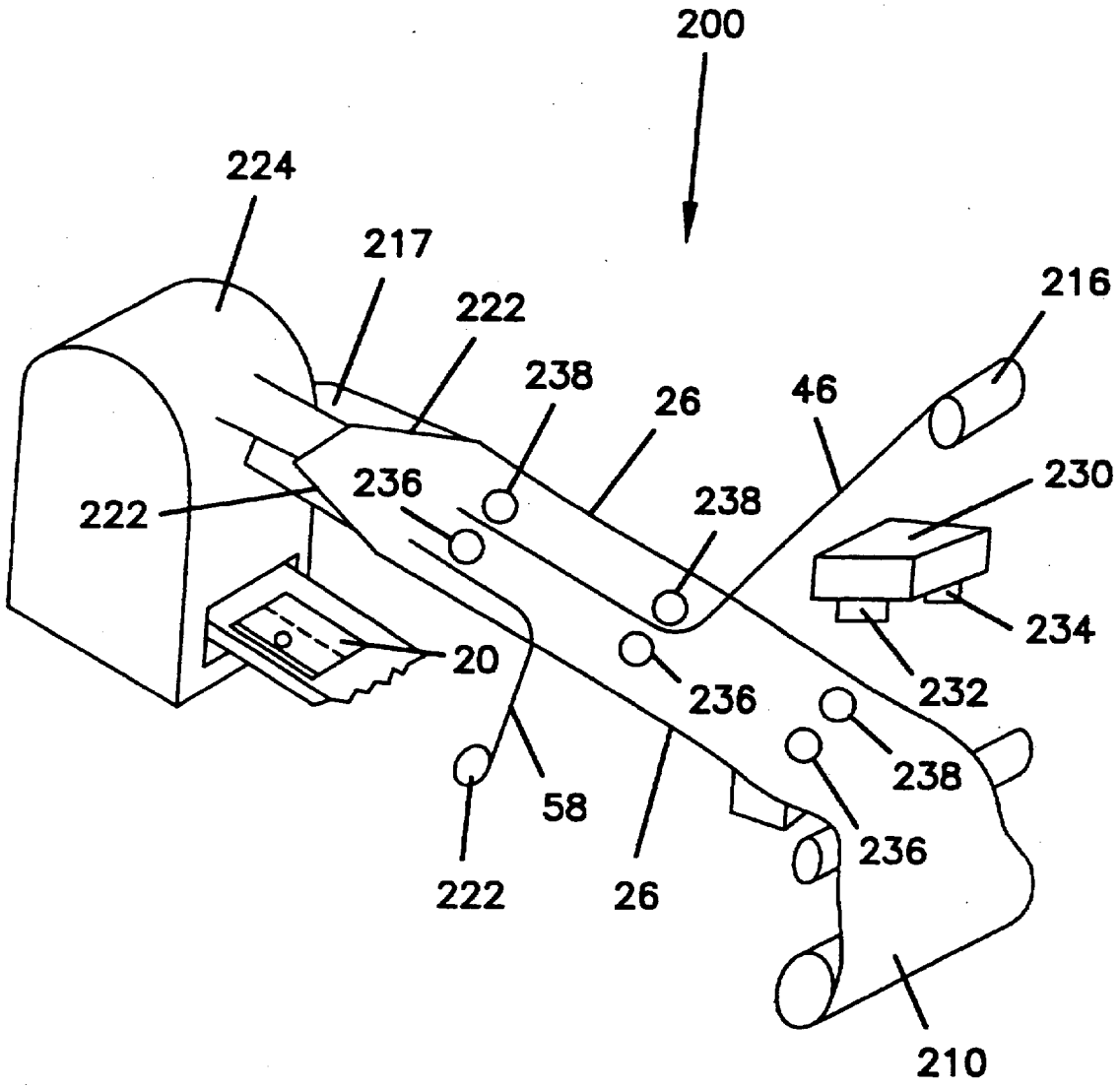
FIG. 7 is a schematic view of one embodiment of a machine for making the flexible package of FIG. 2.

As shown in FIGS. 1, 2, 6 and 7, flexible package 20 represents a variety of packaging arrangements. In the specific embodiments of FIGS. 1 and 2, details of flexible package 20 show it to be a substantially flat, rectangular bag. The package 20 can be made from a roll (or web) of film, as shown in FIGS. 6 and 7. Flexible package 20 can also be implemented using different techniques and in other shapes and sizes, including circular, and may include side and bottom gussets in order to allow the bag to contain more material.

Flexible package 20 is made up of a first panel section 22, and an opposing second panel section 24. As shown in FIGS. 6 and 7, first and second panel sections 22, 24 are made from a single web of thermoplastic film having leading and trailing edges at 26, as shown in FIGS. 6 and 7. The film is folded to create a fold line at 28. In a typical usage of flexible package 20, fold line 28 corresponds to the top of the packaging arrangement, and edges 26 correspond to the bottom of the packaging arrangement. First and second panel sections 22, 24 include a first pair of side edges 32 and a second pair of side edges 34, respectively. First pair of side edges 32 are heat sealed together to form a single, continuous seam. Second pair of side edges 34 are also heat sealed together. As will be explained in more detail in connection with FIGS. 3 and 4, the package is filled after first pair and second pair of side edges 32, 34 are sealed. After filling, leading and trailing edges 26 are heat sealed together to form the complete package.

First and second panel sections 22, 24, when sealed together, form a product containment section 36. Product containment section 36 is constructed to hold a variety of substances. In one arrangement illustrated in FIG. 2, product containment section 36 holds an edible food product 38, such as cheese products, luncheon meat, produce and snacks. Product containment section 36 can also be used to contain non-edible items, such as small hardware parts, crayons, and small toys.

In one application, a thermoplastic film of flexible package 20 is composed of two or more layers of material. The outer layer of material is a heat resistant material such as polyethylene terephthalate (PET), oriented polypropylene, or biaxially-oriented nylon. The inner layer of material is a sealant material such as a combination of low density polyethylene or ethylene vinyl acetate.

A header section, shown generally at 40, includes the area extending from fold line 28 down to the area at which the product containment section 36 begins. The header section 40 includes sufficient area to provide for graphics. Further, header section 40 also provides a portion of flexible package 20 for the user of the package to hold onto when opening or closing the package. Header section 40 is positioned adjacent first and second panel sections 22, 24 and, due to fold line 28, encloses a portion of package 20.

Figure 1:
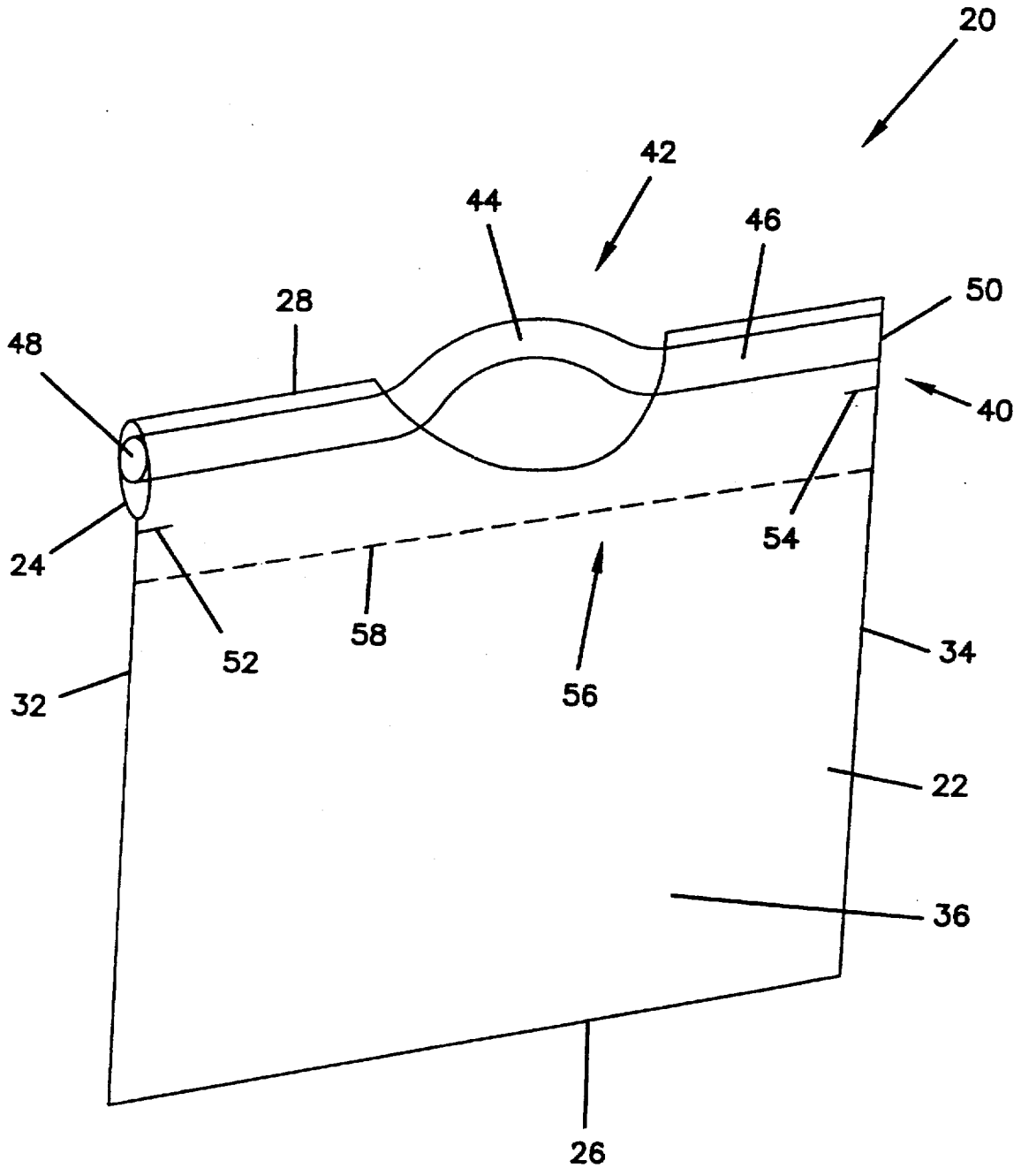
FIG. 1 is a perspective view of one embodiment of a flexible package, implemented according to the present invention.

In the illustrated embodiment of FIG. 1, a hanghole is shown generally at 42, and a tear string is shown at 46. In the FIG. 1 embodiment, hanghole 42 is outlined by a semicircle of film which has been removed from the bag and a curved portion 44 of tear string 46. The FIG. 1 embodiment for hanghole 42 is formed by punching a hole in the polymeric film during the manufacturing process. As will be described in detail below in connection with FIGS. 4 and 5, the film is folded across the diameter of the hole, which results in the generally semicircle cutout shape of hanghole 42 shown in FIG. 1. Hanghole 42 also allows flexible package 20 to be hung on a display rack. Hanghole 42 does not need to be limited to the particular semicircle shape shown in FIG. 1, but can include other shapes so long as a portion of the polymeric film is removed to allow for a hanging structure to hang the package.

In an alternative embodiment, the portion 44 of tear string 46 defining the top of hanghole 42 is straight across. This is useful in applications requiring minimal use of string 46 and/or a manufacturing methodology which eliminates the step of forming or punching the string to form the curved portion.

For each of these implementations, the material removed does not need to be semicircular in shape, but can be shaped as a square, rectangle, ellipse, triangle, etc.

As another implementation, the material removed can be a slit, sufficiently wide to pull therethrough a portion of the tear string and sufficiently narrow to maximize header surface area. This implementation is ideal for applications requiring maximum surface area for graphic and marketing purposes.

Figure 2:
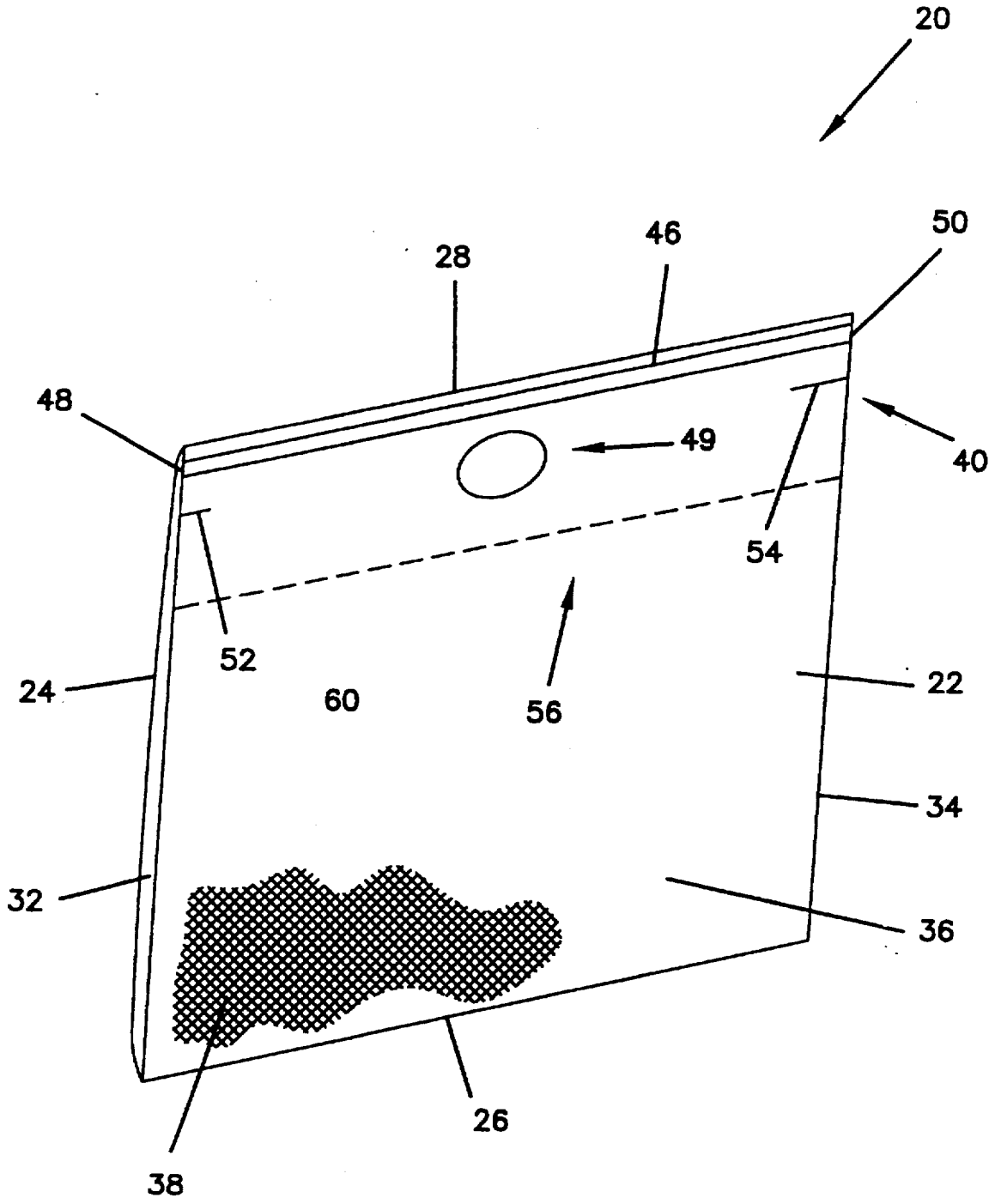
FIG. 2 is perspective view of another embodiment of a flexible package, implemented according to the present invention.

In the embodiment of FIG. 2, another type of hanghole is shown at 49 as being generally circular. As discussed further below in connection with FIGS. 5 and 6, hanghole 49 is formed by punching a pair of holes in the polymeric film and then folding the film over and aligning and matching the pairs of holes together to create hanghole 49 for flexible package 20. In this embodiment, tear string 46 is positioned adjacent to hanghole 49. Hanghole 49 does not need to be limited to the particular circular shape shown in FIG. 2, but can be implemented with other shapes. Preferably, a portion of the polymeric film is removed to allow for a hanging structure to hang the package. For example, the material removed could be square, rectangular, elliptical, star-shaped, triangular, or the like.

Figure 3:
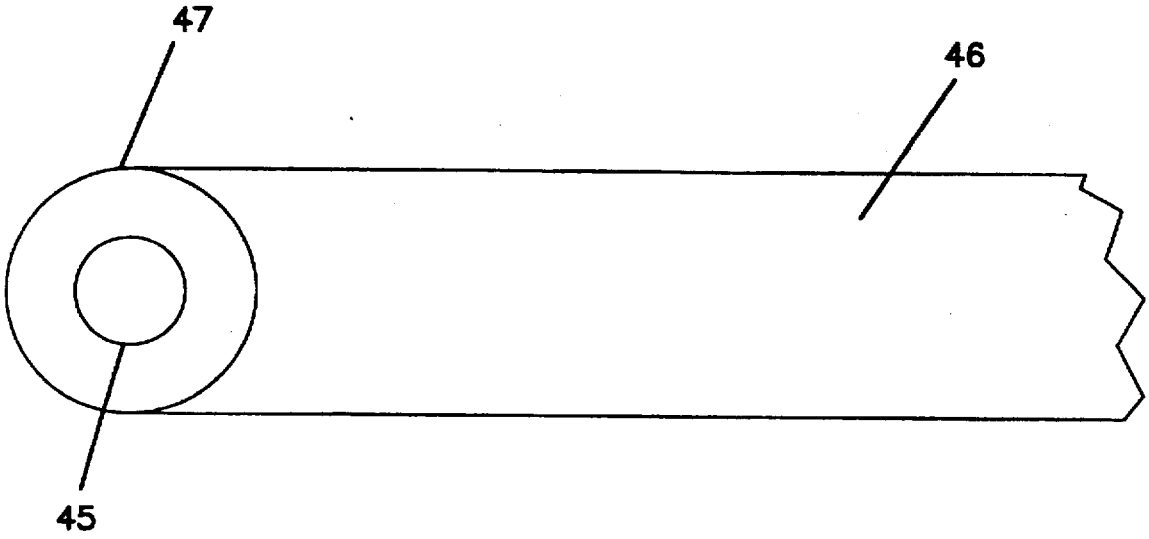
FIG. 3 is a perspective view of an embodiment of a tear string according to the present invention.

Tear string 46 includes first and second ends 48, 50. Tear string 42 is a generally elongated member circular in crosssection which is used to assist the user of flexible package 20 in tearing open the package along fold line 28. Tear string 46 is preferably made of a high density polyethylene cord 45 surrounded by a low temperature sealant 47 such as ethylene vinyl acetate (EVA) type material such as ESCORENE® manufactured by Exxon Chemical Company of Baytown, Tx., as shown in FIG. 3. Tear string 46 is heat sealed to inside surface of header section 40 near fold line 28.

Tear string 46 provides hanging support at hangholes 42, 49. In the FIG. 1 embodiment, tear string 46 is an integral part of hanghole 42. Tear string 46 extends from first side edge 32 of bag 20 to second side edge 34. In approximately the middle between first and second side edges 32, 34, tear string 46 bows outwardly into curved portion 44. Curved portion 44 cooperates with the portions of the polymeric film which were removed in order to create hanghole 42. Because tear string 46 is made of such a strong material, hanghole 42 is able to support significant weights of material in product containment section 36. Further, tear string 46 constitutes an integral part of hanghole 42 by bowing outwardly at curved portion 44, and the amount of material needed to be removed from the polymeric film is lessened, using a slit, as previously discussed, to minimize the waste and maximize surface area.

In the FIG. 2 embodiment, tear string 46 extends the length of flexible package 20 from first side edge 32 to second side edge 34. In this particular embodiment, tear string 46 is above hanghole 49. In another particular embodiment, tear string 46 is arranged as an integral part of hanghole 49 such that hanghole 48 exposes at least a portion of tear string 46. In this way, tear string 46 provides hanging support for hanghole 49 to permit flexible package 20 to hold a greater weight of material in product containment section 36, without stressing any portion of the film immediately below tear string 46.

The inventor has discovered that by providing a tear string sealed within the header section as either an integral part of a hanghole or adjacent to a hanghole, the flexible packaging arrangement is able to hold and support a significant mass of material. This packaging arrangement permits materials to be held with a very large mass including entire blocks of cheese, dense meat products, and any other type of material with a large specific gravity, without undue stress on the package material. For example, this arrangement provides for packaging and hanging for display purposes heavy non-edible products such as dense metal products (e.g., nails, nuts and bolts).

Tear string 46 is used to provide a tearing force to tear open the enclosed portion of flexible package 20 (enclosed by fold line 28) in response to a pulling force by the user at one of first or second ends 48, 50 of tear string 46. The user grasps a portion of header section 40 with one hand, and pulls at one of first or second ends 48, 50 to rip open package 20.

A first tear notch 52 is shown in header section 40 adjacent to first end 48 of tear string 46. Second tear notch 54 is shown in header section 40 adjacent second end 50 of tear string 46. First and second tear notches 52, 54 are small cuts made within the polymeric film material in order to help a user in opening a package to begin a tear line. First and second tear notches 52, 54 cooperate with tear string 46 to give the user an easy and convenient way to remove the seal to flexible package 20.

Other tear notches may be provided in the flexible package. For example, although shown in the illustrated embodiments as having a pair of notches at each end of the tear string, the flexible package can also be implemented with only one tear notch at one end of the tear string. Alternatively, in the FIG. 1 embodiment, an additional pair of tear notches could be provided within the semicircle of hanghole 42 in order to make it easier to rip open package 20 not only at the ends but also in the area of the hanghole. Alternatively, just a single notch could be provided within hanghole 42. Likewise, in the FIG. 2 embodiment, only one tear notch could be provided.

Flexible package may include a reclosable system in the header section. This allows the flexible package to be opened and closed repeatedly. As illustrated, flexible package 20 has a reclosable system 56 mounted within header section 40. In the FIG. 1 embodiment, reclosable system 56 is a reclosable zipper 58. Reclosable zipper 58 can be implemented to include any of a variety of conventional reclosable zippers such as those described and illustrated in U.S. Pat. Nos. 5,403,094; 5,397,182; and 5,470,156, each of which is hereby incorporated by reference. Further, a zipper having a peelable seal that provides a tamper indication and that makes the package hermetic can also be used with the embodiments illustrated herein.

Another preferred reclosable system is embodied in FIG. 2. In the particular reclosable system 56 shown in that embodiment, reclosable system 56 includes a pressure sensitive adhesive-type system 60. A pressure sensitive adhesive-type system may include, for example, a strip of tacky or adhesive material applied to one or both of opposing sides of header section 40.

Flexible package 20 does not have to include a reclosable system 56. For example, in some applications it may not be either necessary or desirable to be able to reclose flexible package 20. In these types of applications, the reclosable system 56 is not manufactured into the arrangement.

In operation, flexible package 20 is used as follows. The product containment section 36 holds edible food product 38, and the package 20 is hung at hanghole 42 or 49. Tear string 46 provides support at hanghole 42 or 49. To open the package, the user grasps header portion 40 with one hand, positions his other hand at one of first or second ends 48, 50 of tear string 46, and at one of tear notches 52, 54 begins pulling. The user then continues to tear across package 20 from one of side edges 32, 34 to the other of side edges 32, 34. The user discards tear string 46 and any other packaging material which was removed with tear string 46. If packaging arrangement 20 includes a reclosable system 56, the user opens the reclosable system 56 to allow access to the food product 38 in product containment section 36. When the user is done accessing food product 38, the user recloses the reclosable system 56 and stores flexible package 20 in an appropriate environment.

Figure 4:
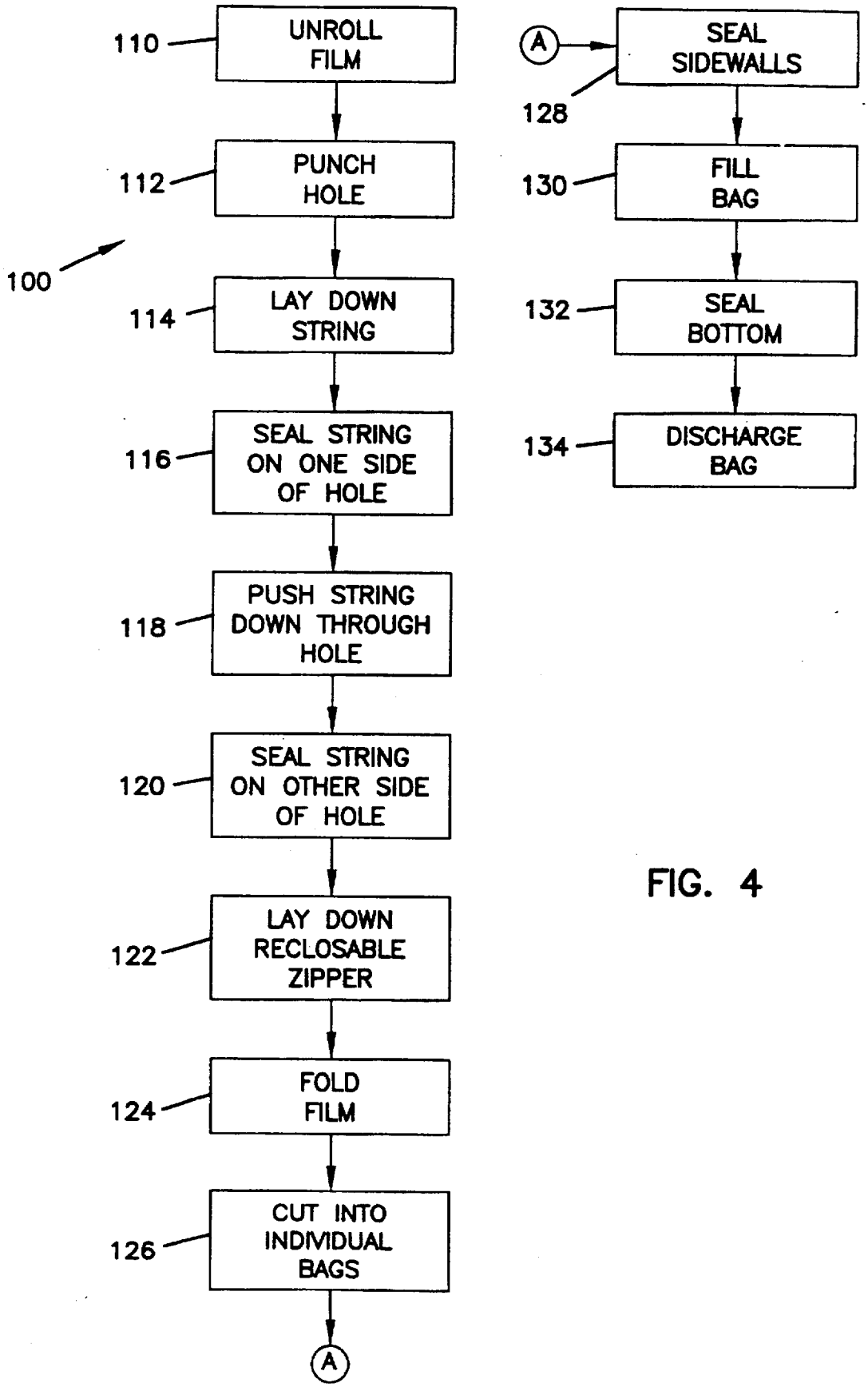
FIG. 4 is an embodiment of one method for constructing the flexible package of FIG. 1.

A method and apparatus for making a flexible package is illustrated in FIGS. 4–7. One method is shown in FIG. 4 at 100, and one apparatus for carrying out method 100 is shown in FIG. 6 at 200. Method 100 shown in FIG. 4 and apparatus 200 shown in FIG. 6 are used to make, for example, a flexible package having a hanghole of the type shown at 42 in the FIG. 1 embodiment.

The first step 110 is to unroll a web of film 210. As was discussed above, the film would include two or more layers of material, the outer layer being a heat resistant material such as polyethylene terephthalate (PET), oriented polypropylene, or biaxially-oriented nylon, and the inner layer being a sealant material such as a combination of low density polyethylene and ethylene vinyl acetate.

The web of film 210 is conveyed downstream by way of a conveyor 217 to a hole punch 214. In step 112, a hole 212 is punched in the film with hole puncher 214. Any conventional hole puncher is suitable. The hole may be circular in shape but does not necessarily need to be circular in view of the alternative hole shapes previously described.

The next step 114 is to lay down tear string 46. Tear string 46 is unrolled from a roll 216 of string and is laid across the diameter of hole 212. Tear string 46 does not have to be laid across the diameter, but can be laid across any dimension of hole 212. Tear string 46 may be covered with a low temperature sealant material such as ethylene vinyl acetate (EVA) type material such as ESCORENE® manufactured by Exxon Chemical Company of Baytown, Tx. As the string is laid down, it is sealed across one side of the hole in step 116. In the next step 118, string 46 is pushed across the hole with a conventional pusher 218 in order to create curved portion 44. As discussed above, the inventor has discovered that tear string 46, when pushed to form curved portion 44, results in less waste via the portion of polymeric film that is punched out, and allows for a greater area of packaging space in order to print graphics.

In step 120, string 46 is sealed on the other side of hole 42. A roller 220 pushes string 46, which is covered with the sealant material, against the film in order to help seal it to the film.

Next, in step 122, the reclosable system is positioned onto the film. For example, a reclosable zipper 58 is unrolled from a roll 222 of zippers to be placed on one side of the hole 42 and tear string 46. This step is optional. If no reclosable system is desired, step 122 is omitted.

Step 124 is to fold the film using guides 222 to guide the film into a folded arrangement. Specifically, film is folded along approximately the diameter of hole 42 to match edges 26. In other words, the film would be folded in such a way that tear string 46 is immediately adjacent fold line 28.

Next, at step 126, the film is cut into individual bags at a separator 224, which cuts and seals. When individual bags are cut, edges 32 and 34 are created. Edges 32 and 34 are heat sealed at step 128. The bag is then filled at step 130 with edible food product 38, or whatever is being packaged, and then leading and trailing edges 26 are heat sealed to completely enclose the package. Finally, the package is discharged at step 134.

A conventional horizontal form, fill, and seal machine can be suitably modified to provide the methodology as described above to construct a packaging arrangement such as that shown in FIG. 1. Such a machine is described in U.S. Pat. No. 3,274,746 to James et al., hereby incorporated by reference. Another machine, suitably modified as described above, is described in U.S. Pat. No. 5,036,643 to Bodolay, hereby incorporated by reference.

Figure 5:
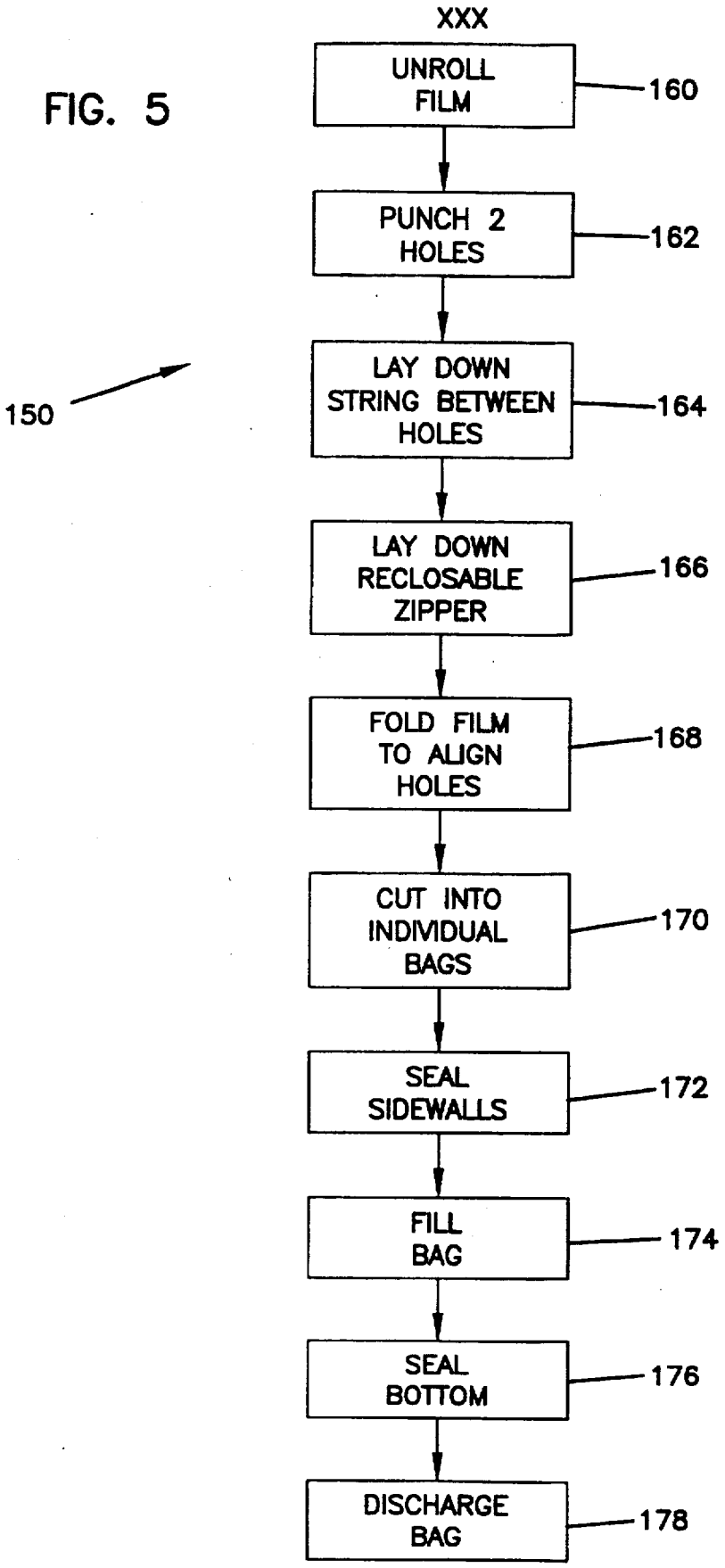
FIG. 5 is an embodiment one method for constructing the flexible package of FIG. 2.

Another method and apparatus for making a flexible package is shown in FIG. 5 and FIG. 7. The method in FIG. 5 is shown generally at 150. Method 150 provides a flexible package with the type of hanghole 49 shown in FIG. 2.

First step 160 is to unroll the film from roll 210. This is the same kind of film described in the embodiment shown at 100.

Next, film is conveyed by conveyor 217 downstream to a hole puncher 230. At step 162, a pair of holes 236, 238 are punched in the film by puncher 230. Puncher 230 includes a first punch 232 and a second punch 234 for removing the material in the film to result in holes 236 and 238, respectively. The holes are punched so that once the film is folded over itself, the holes can be aligned with each other to result in hanghole 49. Puncher 230 can be any conventional hole puncher as is known in the art. It is not necessary that holes 49 be circular, but could be implemented in other sizes and shapes.

At step 164, tear string 46 is positioned between holes 236 and 238. Tear string 46 is unrolled from roll 216 and is surrounded by a low temperature sealant such as an EVA type material.

If a reclosable system is desired in this particular application, the reclosable system is next positioned adjacent to one of the holes at step 166. For example, a reclosable zipper 58 is unrolled from roll 222 and laid next to one of the holes.

At step 168, the film is folded as guides 222 guide the film to match leading and trailing edges 26 and to align the holes concentrically with each other. The film should be folded such that the holes are aligned with each other and that the tear string 46 is along and immediately adjacent to fold line 28.

At step 170, the film is cut at separator 224 into individual bags to create first and second side edges 32, 34. At step 172, edges 32 and 34 are heat sealed to result in a package which is then enclosed along three sides, i.e. 32, 34, 28. At step 174, flexible package 20 is filled with whatever is being packaged, such as edible food product 38. At step 176, leading and trailing edges 26 are heat sealed together to result in an individual package 20. In connection with the last step 178, package 20 is discharged.

Again, one machine, suitably modified as described above, which can construct a packaging arrangement such as that shown in FIG. 2, is a horizontal form, fill, and seal machine, such as that described in U.S. Pat. No. 3,274,746 to James et al. Another machine, suitably modified as described above, is described in U.S. Pat. No. 5,036,643 to Bodolay. A vertical form, fill, and seal machine also could be used to construct a package arrangement in accordance with the invention.

Further, portions of the illustrated arrangements may be made according to what is described in U.S. Pat. No. 5,480,230 to May, hereby incorporated by reference.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

I claim:

1. A method for making a flexible package comprising:

unrolling a web of film;

punching a plurality of holes in the film at a designated header area;

positioning a tear string across the film in the header area; and arranging the film into a plurality of individual packages, each package having one of the plurality of holes, a section of the header area, and a section of the tear string positioned to strengthen the header area for hanging support at the hole, wherein the step of positioning a tear string includes positioning a tear string across the hole such that the length of the tearstring spanning the hole exceeds the maximum diameter of the hole.

2. The method of claim 1, wherein the step of arranging includes:

folding the film in the header area;

cutting the film into individual packages having three pairs of exposed edges;

sealing two pairs of edges to leave a third pair of edges unsealed;

filling the packages with a product; and sealing the third pair of edges.

3. The method of claim 1, further including the step of sealing the tear string on a first area of the film on a first side of the hole, before the step of positioning the tear string across the hole.

4. The method of claim 3 further including the step of sealing the tear string on a second area of the film on a second side of the hole, after the step of positioning the tear string across the hole.

5. The method of claim 1, wherein the step of punching a hole includes punching a pair of holes in the film.

6. The method of claim 5, wherein the step of arranging includes:

folding the film between the pair of holes to ensure that the holes are aligned together;

cutting the film into individual packages having three pairs of exposed edges;

sealing two pairs of edges to leave a third pair of edges unsealed;

filling the packages with a product; and sealing the third pair of edges.

7. The method of claim 5, wherein the step of positioning a tear string includes positioning a tear string between the pair of holes.

8. The method of claim 5, further including the step of positioning a reclosable zipper onto the film.

9. The method of claim 1, further including the step of positioning a reclosable zipper onto the film.

10. A method for making a flexible package comprising:

unrolling a web of film;

punching a plurality of holes in the film at a designated header area;

positioning a tear string across the film in the header area; and arranging the film into a plurality of individual packages, each package having one of the plurality of holes, a section of the header area, and a section of the tear string positioned to strengthen the header area for hanging support at the hole, wherein the step of punching a plurality of holes includes punching a pair of holes in the film, and wherein the step of arranging includes:

folding the film between the pair of holes to ensure that the holes are aligned together;

cutting the film into individual packages having three pairs of exposed edges;

sealing two pairs of edges to leave a third pair of edges unsealed;

filling the packages with a product; and sealing the third pair of edges.

11. The method of claim 10, further including the steps of positioning the tear string across the hole and sealing the tear string on a first area of the film on a first side of the hole, before the step of positioning the tear string across the hole.

12. The method of claims 11, further including the step of sealing the tear string on a second area of the film on a second side of the hole, after the step of positioning the tear string across the hole.

13. The method of claim 10, wherein the step of positioning a tear string includes positioning a tear string across the hole such that the length of the tearstring spanning the hole exceeds the maximum diameter of the hole.

14. The method of claim 13, further including the step of positioning a reclosable zipper onto the film.

* * * * *